US008651611B2

(12) United States Patent
Katayama

(10) Patent No.: US 8,651,611 B2
(45) Date of Patent: Feb. 18, 2014

(54) INK JET RECORDING APPARATUS

(75) Inventor: Toru Katayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 163 days.

(21) Appl. No.: 13/407,349

(22) Filed: Feb. 28, 2012

(65) Prior Publication Data

US 2012/0249648 A1 Oct. 4, 2012

(30) Foreign Application Priority Data

Mar. 31, 2011 (JP) ..... 2011-079870

(51) Int. Cl.
*B41J 29/38* (2006.01)
*B41J 29/393* (2006.01)
*B41J 2/01* (2006.01)

(52) U.S. Cl.
USPC ..... 347/16; 347/19; 347/101; 347/104; 347/105

(58) Field of Classification Search
USPC ..... 347/16, 19, 101, 104–105
See application file for complete search history.

(56) References Cited

U.S. PATENT DOCUMENTS

| | | | | |
|---|---|---|---|---|
| 7,857,411 | B2 | 12/2010 | Ito | |
| 8,328,313 | B2 | 12/2012 | Takeda et al. | |
| 8,403,448 | B2 * | 3/2013 | Yasukawa et al. | 347/16 |

FOREIGN PATENT DOCUMENTS

| | | | |
|---|---|---|---|
| EP | 1 790 487 | A1 | 5/2007 |
| JP | 09-124185 | A | 5/1997 |
| JP | 2001-96727 | A | 4/2001 |
| JP | 2003-212387 | A | 7/2003 |
| JP | 2007-144633 | A | 6/2007 |
| JP | 2010-52388 | A | 3/2010 |
| JP | 2010-228164 | A | 10/2010 |
| JP | 2011-051215 | A | 3/2011 |

OTHER PUBLICATIONS

Foreign Office Action of JP 2011-079870 dated Apr. 30, 2013.

* cited by examiner

*Primary Examiner* — Jason Uhlenhake
(74) *Attorney, Agent, or Firm* — Birch, Stewart, Kolasch & Birch, LLP

(57) ABSTRACT

An ink jet recording apparatus includes a processing barrel for performing predetermined processing on a recording medium, transfer barrels disposed upstream and downstream of the processing barrel, two detection sensors facing the two transfer barrels, respectively, each detecting the pass of the recording medium, and a detecting circuit for detecting an abnormal pass of the recording medium from two output signals output from the two sensors and including two reverse logic delay timers, each delaying timing of a logic reverse to a detection logic of each of the two sensors with respect to the each output signals. Signal changes shorter than timer setting periods of the timers are removed from the output signals, respectively, to thereby prevent detection errors of the abnormal pass of the recording medium.

16 Claims, 7 Drawing Sheets

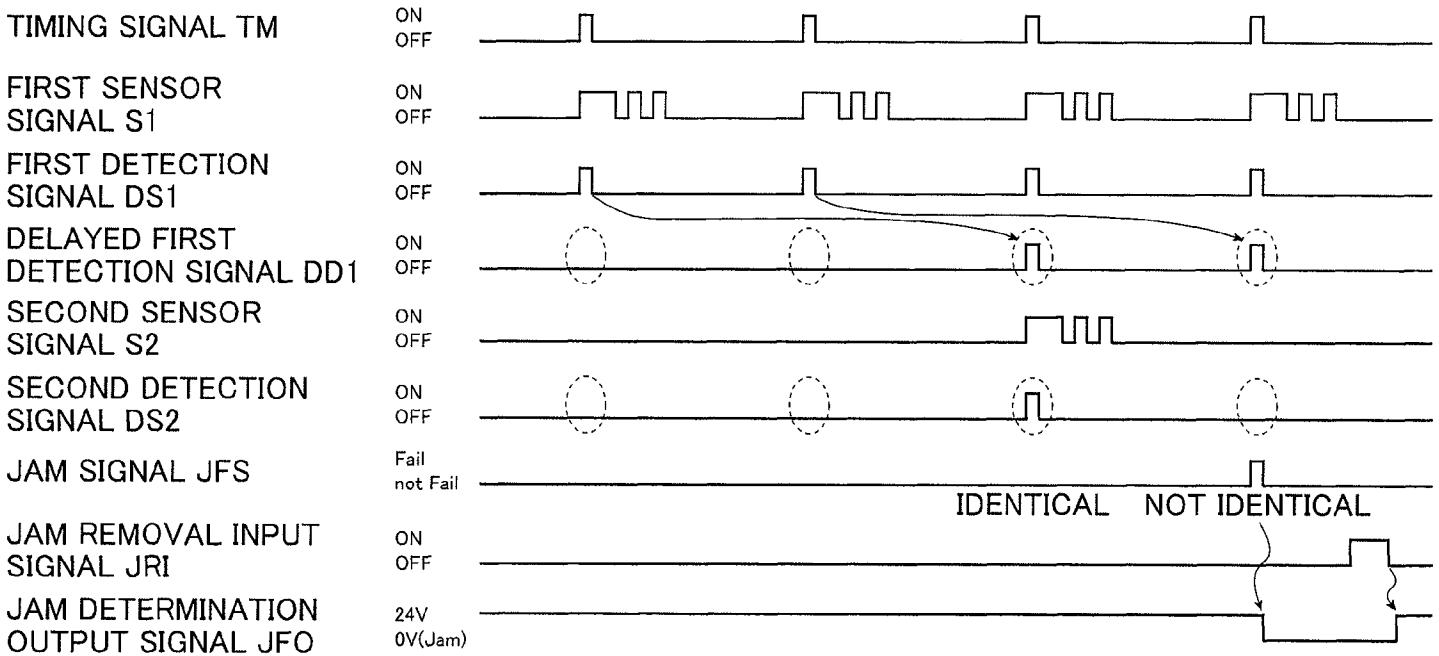
FIG. 4A TIMING SIGNAL TM
ON
OFF
FIG. 4B FIRST SENSOR SIGNAL S1
ON
OFF
FIG. 4C FIRST DETECTION SIGNAL DS1
ON
OFF
FIG. 4D DELAYED FIRST DETECTION SIGNAL DD1
ON
OFF
FIG. 4E SECOND SENSOR SIGNAL S2
ON
OFF
FIG. 4F SECOND DETECTION SIGNAL DS2
ON
OFF
FIG. 4G JAM SIGNAL JFS
Fail
not Fail
IDENTICAL
NOT IDENTICAL
FIG. 4H JAM REMOVAL INPUT SIGNAL JRI
ON
OFF
FIG. 4I JAM DETERMINATION OUTPUT SIGNAL JFO
24V
0V(Jam)

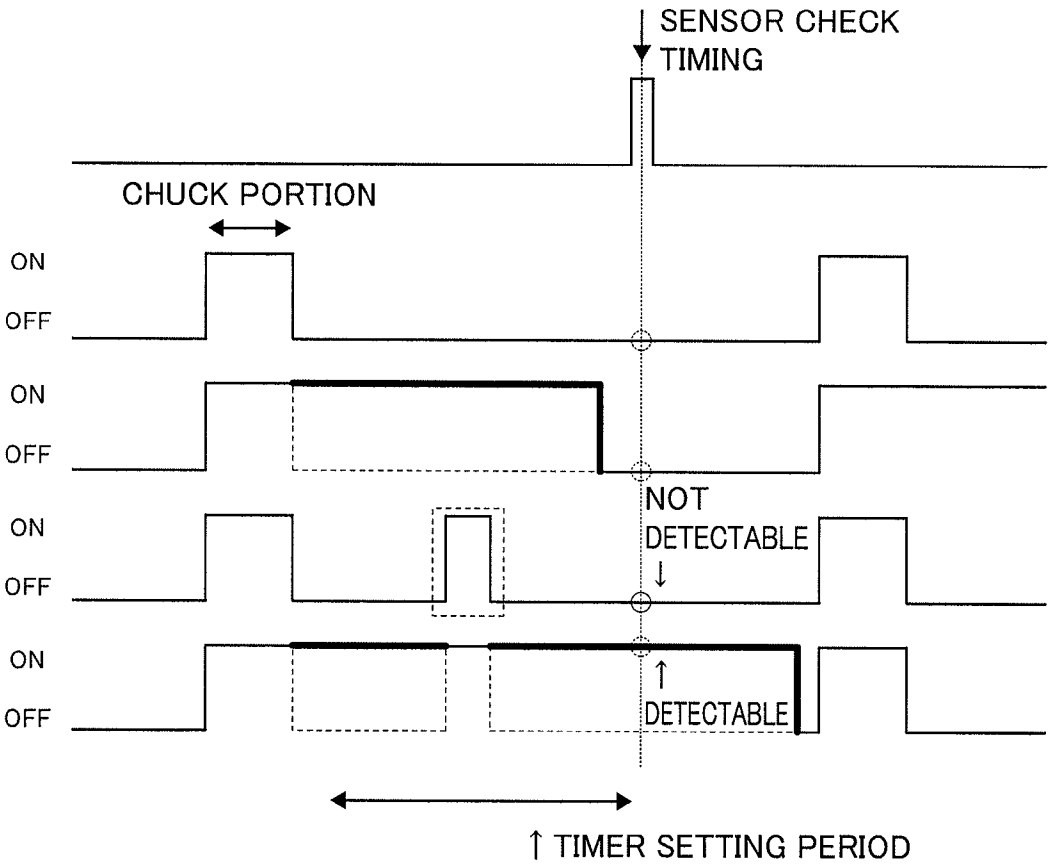
FIG. 6A TIMING SIGNAL TM
FIG. 6B SENSOR SIGNAL Sa
FIG. 6C OFF-DELAY SENSOR SIGNAL Se
FIG. 6D SENSOR SIGNAL Sf
FIG. 6E OFF-DELAY SENSOR SIGNAL Sg

INK JET RECORDING APPARATUS

BACKGROUND OF THE INVENTION

The present invention relates to an ink jet recording apparatus. More specifically, the present invention relates to an ink jet recording apparatus which includes transfer barrels before and after a processing barrel that performs predetermined processing, such as a drying barrel that dries a recording medium such as a cut sheet-shaped recording sheet on which an image is recorded with ink droplets, and which is capable of preventing detection errors of an abnormal pass (a paper jam, namely a jam) of a recording medium by a detection sensor that is disposed in each of the two transfer barrels so as to detect a pass (sheet pass) of the recording medium.

In the related art, an ink jet recording apparatus that performs recording by ejecting ink droplets from nozzle holes of an ink jet head to form an image on a cut sheet-shaped recording sheet is used as a printer.

In such an ink jet recording apparatus, a conveying unit such as a conveying roller conveys recording sheets picked up one by one in a feeding tray from a sheet feeding unit onto a platen of an image forming unit (a recording unit). Ink droplets are ejected imagewise from the nozzle holes of an ink jet head while scanning the ink jet head relative to the recording sheet on the platen to form an image on the recording sheet. The recording sheet on which an image based on the ink droplets is formed is conveyed to a drying unit and is heated and dried. The recording sheet in which the image is fixed is discharged to a discharge tray.

In such an ink jet recording apparatus, since the conveying unit conveys recording sheets picked up one by one, a paper jam, commonly called a jam may occur in various portions, such as, for example, a sheet-pickup unit from the feeding tray, an image forming unit, a drying unit, a discharging unit, and a processing unit that performs pre-processing or post-processing on a recording sheet. When a jam occurs, it is necessary to open the portion where the jam occurs and remove the jammed sheet, for example, by pulling out the recording sheet. In particular, jams occurring in the image forming unit that includes an ink jet head which may cause a problem such as ejection error during image formation and the drying unit which may cause abnormal heating or abnormal temperature rise are critical. Thus, it is necessary to detect a jam accurately and quickly and stop ejection of droplets from the nozzles of the ink jet head and drying in the drying unit.

In particular, in the drying unit, the recording sheet may get burnt or catch fire due to abnormal heating or an abnormal temperature rise, a user may get burned when removing the recording sheet, and constituent elements may be damaged. JP 2001-96727 A proposes an ink drying device which includes an abnormality detecting unit that detects an abnormality, for example, a jam in a drying region (drying unit), and a control unit that stops the driving of a heater in the drying region when an abnormality is detected by the abnormality detecting unit and then drives only a cooling unit for a predetermined period until the temperature of the drying region decreases to a predetermined temperature.

The ink drying device of JP 2001-96727 A uses a jam detecting unit that detects a stay for a predetermined period or longer of an ink-attached recording medium inside the device as well as a temperature detecting unit as the abnormality detecting unit. In the ink drying device of JP 2001-96727 A, sheet detecting sensors that detect the entrance and exiting of a recording sheet are arranged at the input and output ports of the ink drying device (dryer) as the jam detecting unit so as to detect a jam by determining whether the recording sheet stays for a predetermined period or longer based on the period between the entrance and the exiting of the recording sheet.

Moreover, in the recording unit, since it is desirable that the gap between the ink jet head and the recording sheet is as small as possible from the perspective of image quality, the gap is set to be very small taking a bending state and a floating of the recording sheet into consideration. Therefore, when a jam occurs, and the portion where the jam occurs is opened, sheet powder, dust, or the like may enter into the nozzles of the ink jet head. Moreover, when removing by pulling out the recording sheet, the ink jet head may be damaged by the recording sheet contacting therewith, and the nozzles may cause ejection errors. Furthermore, the recording sheet may be torn to pieces by being caught at the ink jet head or other members, and the torn pieces remain there, which may cause another jam or other problems such as a failure in various portions.

Therefore, JP 2007-144633 A proposes an ink jet recording apparatus which includes a jam detecting unit that detects a jam of a recording sheet and a gap varying unit that varies the gap between an ink jet head and a platen based on the results of the detection by the jam detecting unit.

By doing so, the ink jet recording apparatus of JP 2007-144633 A makes it easy to remove the jammed recording sheet when a jam is detected by increasing the gap between the ink jet head and the platen when removing the jammed recording sheet. In this way, the recording sheet is prevented from making contact with the ink jet head.

In the ink jet recording apparatus of JP 2007-144633 A, an entrance sensor provided on the entrance side on the conveyance path of a recording sheet, a registration sensor provided right before a print region, an exit sensor provided on the exit side, and a timer are used as the jam detecting unit. The ink jet recording apparatus calculates the period taken to convey the recording sheet by the distance between the entrance sensor and the registration sensor at a predetermined speed, calculates the period taken to convey the recording sheet by the distance between the registration sensor and the exit sensor in accordance with printing conditions such as the length in the longitudinal direction of the recording sheet, an image-quality mode, and the quantity of print data, and calculates a total conveyance period obtained by adding both periods. When a front sensor such as the entrance sensor or the registration sensor detects the leading end or the trailing end of the recording sheet, or when a print timing occurs, the timer is started. It is determined that a jam has occurred when the rear sensor was unable to detect the leading end or the trailing end of the recording sheet after the conveyance period corresponding to the distance between two sensors has elapsed. Moreover, it is determined that a jam has occurred when one sensor which has detected the leading end of the recording sheet was unable to detect the trailing end after the elapse of the time taken for the leading end and the trailing end of the recording sheet to pass through the sensor.

SUMMARY OF THE INVENTION

The jam detecting unit disclosed in JP 2001-96727 A and JP 2007-144633 A detects the jam of the recording sheet by comparing the conveyance period taken for the recording sheet to convey between two sheet detecting sensors on the upstream side and the downstream side in the conveying direction of the recording sheet with the detection timings at which the leading end and the trailing end of the recording sheet are detected by the two sensors. In the jam detection method, it is required that the leading end and the trailing end of the recording sheet are correctly detected by the sheet detecting sensors.

However, depending on a method of conveying the recording sheet, the sheet detecting sensors may not be able to correctly and stably detect the leading end and the trailing end of the recording sheet, and the detection timings may not be accurate. For example, when a reflective sensor is used as the sheet detecting sensor, the sensor may not be able to stably detect the leading end and the trailing end of the recording sheet depending on the conditions (the magnitude of fluctuation due to the sheet thickness, a decrease in reflectivity due to the colors on the detection surface side of the sheet, or the like) when the recording sheet passes through the sensor portion. In particular, when conveying the recording sheet with only the leading end grasped, the recording sheet is more likely to fluctuate due to the thickness. As a result, it becomes difficult to accurately detect the leading end and the trailing end of the recording sheet.

The present invention has been made to solve the problems as described above, and an object of the present invention is to provide an ink jet recording apparatus capable of preventing detection errors of an abnormal pass such as a paper jam, namely, a jam, of a recording medium by a detection sensor by stabilizing accurate detection of a pass of a cut sheet-shaped recording medium by a recording medium detecting sensor, namely detection of the leading end or the trailing end of a recording medium, and detecting an abnormal pass of the recording medium accurately.

In order to achieve the above object, the present invention provides an ink jet recording apparatus that ejects droplets from nozzles of an ink jet head to record an image on a cut sheet-shaped recording medium, comprising: a processing barrel that performs predetermined processing on the recording medium while rotating with the recording medium retained on an outer circumferential surface thereof; a transfer barrel that is disposed on an upstream side or a downstream side in a conveying direction of the recording medium with respect to the processing barrel so as to retain the recording medium on an outer surface thereof and transfer or receive the recording medium to or from the processing barrel by rotating with a leading end of the recording medium grasped; a conveying unit that is disposed on the opposite side of the transfer barrel in the conveying direction of the recording medium with respect to the processing barrel so as to convey the recording medium from or to the processing barrel; a first detection sensor and a second detection sensor that are provided so as to face the transfer barrel and the conveying unit to detect a pass of the recording medium; and an abnormal pass detecting circuit that receives a first output signal output from the first detection sensor and a second output signal output from the second detection sensor so as to detect an abnormal pass of the recording medium from the received first and second output signals, wherein the abnormal pass detecting circuit includes a first reverse logic delay timer that delays the timing of a logic reverse to a detection logic of the first detection sensor with respect to the first output signal, and a second reverse logic delay timer that delays the timing of a logic reverse to a detection logic of the second detection sensor with respect to the second output signal, and wherein signal changes shorter than timer setting periods of the first and second reverse logic delay timers are removed from the first and second output signals, respectively, to thereby prevent detection errors of the abnormal pass of the recording medium by the abnormal pass detecting circuit.

It is preferable that the first and second detection sensors are sensors of which the detection logics become ON when the recording medium passes, and the first and second reverse logic delay timers are OFF-delay timers that add an OFF delay to the first and second output signals. Alternatively, it is preferable that the first and second detection sensors are sensors of which the detection logics become OFF when the recording medium passes, and the first and second reverse logic delay timers are ON-delay timers that add an ON delay to the first and second output signals.

It is preferable that the first and second reverse logic delay timers are each configured to be capable of switching the timer setting period thereof, and the abnormal pass detecting circuit is configured to be capable of switching the detection timing at which the first and second detection signals indicating a pass of the recording medium are detected from the first and second output signals, respectively.

The timer setting period of each of the first and second reverse logic delay timers and the detection timing of the abnormal pass detecting circuit at which the first and second detection signals indicating a pass of the recording medium are detected from the first and second output signals, respectively, are preferably switched in accordance with the length of the recording medium in the conveying direction and a conveying speed of the recording medium in the transfer barrel and the conveying unit.

Preferably, the detection timing is delayed from the timing of the first output signal, indicating the pass of the recording medium by the timer setting period of the first reverse logic delay timer or longer.

The processing barrel preferably performs the predetermined processing on the recording medium while retaining the recording medium on the outer circumferential surface thereof by rotating with the leading end of the recording medium grasped.

It is preferable that one of the transfer barrel and the conveying unit is a first transfer barrel that is disposed on the upstream side in the conveying direction of the recording medium with respect to the processing barrel so as to retain the recording medium on the outer surface thereof and transfer the recording medium to the processing barrel by rotating with the leading end of the recording medium grasped, and the other of the transfer barrel and the conveying unit is a second transfer barrel that is disposed on the downstream side in the conveying direction of the recording medium with respect to the processing barrel so as to retain the recording medium on the outer surface thereof and receive the recording medium from the processing barrel by rotating with the leading end of the recording medium grasped.

It is preferable that the processing barrel includes a first grasping unit that grasps the leading end of the recording medium, and is configured to rotate while retaining the recording medium of which the leading end is grasped by the first grasping unit on the outer circumferential surface thereof to thereby perform the predetermined processing on the recording medium, the first transfer barrel includes a second grasping unit that grasps the leading end of the recording medium, and is configured to rotate in contact with the processing barrel while retaining the recording medium of which the leading end is grasped by the second grasping unit on the outer surface thereof to thereby transfer the recording medium to the processing barrel by changing the state of the recording medium being grasped by the second grasping unit to the state of the recording medium being grasped by the first grasping unit of the processing barrel, and that the second transfer barrel includes a third grasping unit that grasps the leading end of the recording medium, and is configured to rotate in contact with the processing barrel while retaining the recording medium of which the leading end is grasped by the third grasping unit on the outer surface thereof to thereby receive the recording medium from the processing barrel by changing the state of the recording medium being grasped by the first grasping unit of the processing barrel to the state of the recording medium being grasped by the third grasping unit.

The abnormal pass detecting circuit preferably includes: a first detection circuit that outputs a first detection signal indicating the pass of the recording medium based on a predetermined detection timing signal from the first output signal which is output from the first detection sensor and processed by the first reverse logic delay timer; a delay circuit that delays the first detection signal output from the first detection circuit by a predetermined setting period and outputs a delayed first detection signal; a second detection circuit that outputs a second detection signal indicating the pass of the recording medium based on the predetermined detection timing signal from the second output signal which is output from the second detection sensor and processed by the second reverse logic delay timer; and an abnormal pass determining circuit that determines the abnormal pass of the recording medium from the delayed first detection signal output from the delay circuit and the second detection signal output from the second detection circuit.

The abnormal pass determining circuit preferably compares the delayed first detection signal with the second detection signal to determine the abnormal pass of the recording medium.

More preferably, the abnormal pass determining circuit compares the delayed first detection signal and the second detection signal to determine that the pass of the recording medium is normal when both signals are identical and determine that the pass of the recording medium is abnormal when both signals are not identical.

It is preferable that the processing barrel is a drying barrel that rotates while retaining the recording medium on which the image is recorded by the ink jet head on the outer circumferential surface thereof so as to dry the image formed by the droplets on the recording medium.

It is also preferable that the processing barrel is an image forming barrel that rotates while retaining the recording medium on the outer circumferential surface thereof to convey the recording medium and ejects droplets from the nozzles of the ink jet head to thereby form the image.

It is preferable that the first and second detection sensors are reflective sensors.

Preferably, the first and second detection sensors detect the leading end of the recording medium.

According to the present invention, with the above configuration, it is possible to prevent detection errors of an abnormal pass such as a paper jam, namely, a jam, of a recording medium by a recording medium detection sensor by stabilizing accurate detection of a pass of a cut sheet-shaped recording medium by a recording medium detecting sensor, namely detection of the leading end or the trailing end of a recording medium, and to detect an abnormal pass of the recording medium accurately.

BRIEF DESCRIPTION OF THE DRAWINGS

FIGS. 4A to 4I are timing charts of an example of signals of respective units, for explaining a jam detection method of the jam detection circuit shown in FIG. 3.

FIGS. 6A to 6E are timing charts of another example of a timing signal and sensor output signals, for explaining the effects of an OFF-delay timer of the jam detection circuit shown in FIG. 3.

DETAILED DESCRIPTION OF THE INVENTION

An ink jet recording apparatus according to the present invention will be explained in detail below based on preferred embodiments shown in the accompanying drawings.

Figure 1:
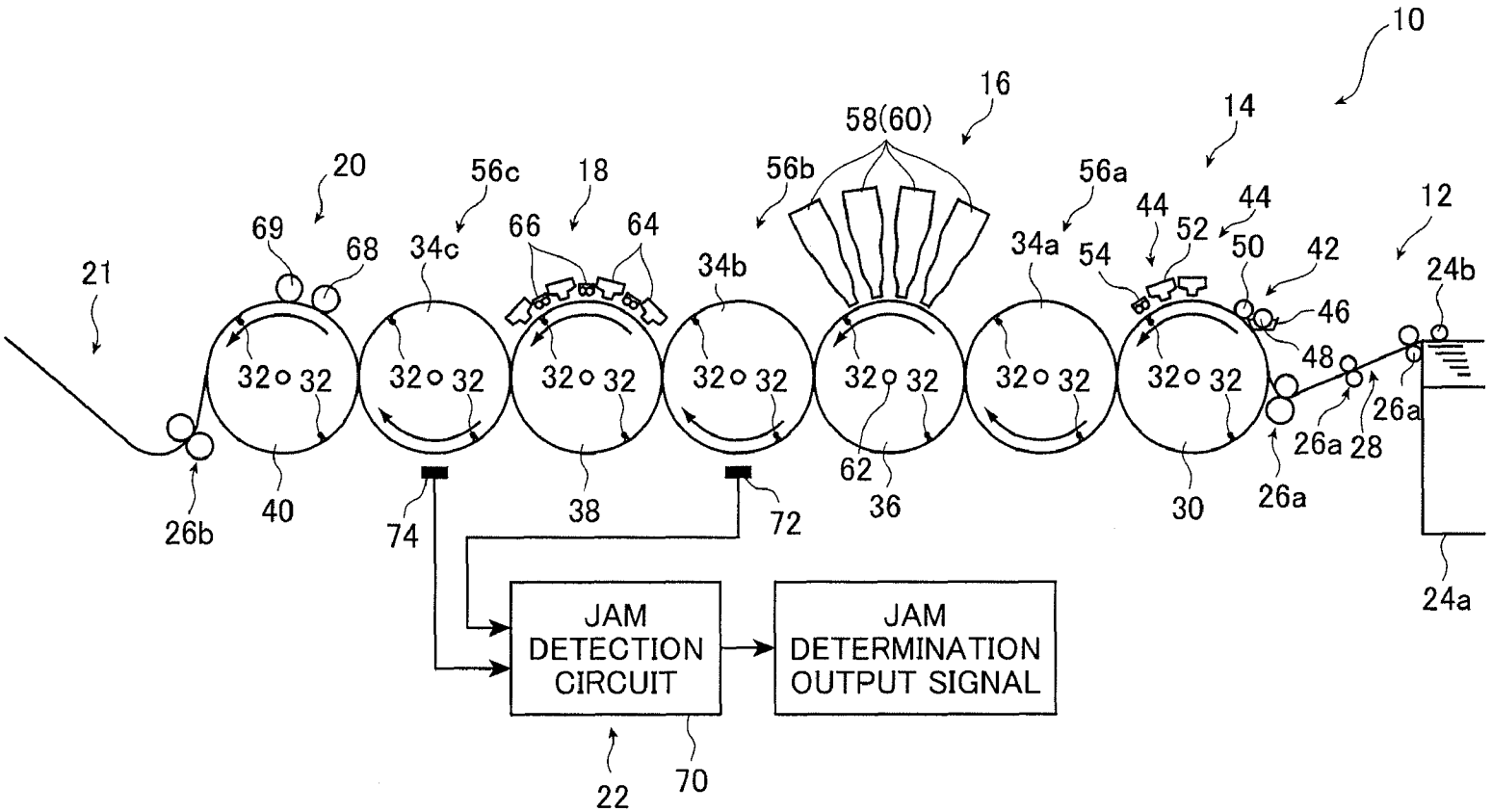
FIG. 1 is a schematic configuration view showing an apparatus configuration of an example of an ink jet recording apparatus according to an embodiment of the present invention.
Figure 2:
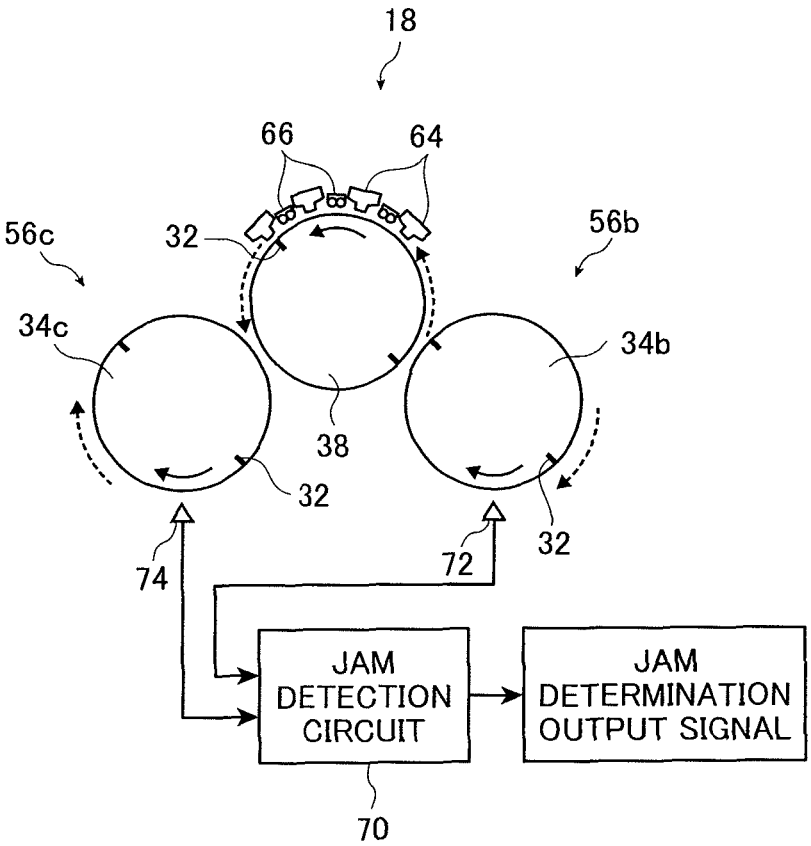
FIG. 2 is a schematic configuration view illustrating a main part of an ink jet recording apparatus shown in FIG. 1.

FIG. 1 is a schematic configuration view showing an apparatus configuration of an example of an ink jet recording apparatus according to an embodiment of the present invention. FIG. 2 is a schematic configuration view illustrating a main part of an ink jet recording apparatus shown in FIG. 1.

As shown in FIG. 1, an ink jet recording apparatus 10 of the present embodiment includes a sheet feeding and conveying unit 12 that is disposed on the upstream side of a sheet conveying direction so as to feed and convey sheets of paper (hereinafter, referred to as a recording sheet or a unit sheet) serving as a recording medium, a processing liquid application unit 14 that is disposed on the downstream side of the sheet feeding and conveying unit 12 so as to apply a processing liquid onto a recording surface of a sheet along the sheet conveying direction, an image forming unit 16 that forms an image on a recording surface of a sheet, an ink drying unit 18 that dries an image formed on the recording surface, an image fixing unit 20 that fixes the dried image onto the sheet, and a discharging unit 21 that discharges the sheet to which the image is fixed.

Moreover, the ink jet recording apparatus 10 of the present embodiment includes a jam detecting unit 22 according to the present invention.

Hereinafter, the respective processing units will be described.

(Sheet Feeding and Conveying Unit)

A stacking unit 24*a* in which sheets are stacked is provided in the sheet feeding and conveying unit 12, and a sheet feeding unit 24*b* that feeds sheets stacked in the stacking unit 24*a* one by one is provided on the downstream side in the sheet conveying direction (hereinafter, sometimes referred to simply as a downstream side) of the stacking unit 24*a*. The sheet fed by the sheet feeding unit 24*b* is conveyed to the processing liquid application unit 14 through a conveying unit 28 which includes a plurality of conveying roller pairs 26*a*.

(Processing Liquid Application Unit)

A processing liquid application drum (barrel) 30 which is a processing barrel of the present invention is rotatably arranged in the processing liquid application unit 14. The processing liquid application drum 30 is disposed between a conveying roller pair 26*a* on the most downstream side of the sheet feeding and conveying unit 12 on the upstream side and an intermediate conveying drum 34*a* of an intermediate conveying unit 56*a*. Chucks 32 which are grasping members that grasp the leading end of a sheet are provided in the processing liquid application drum 30. The chucks 32 receive a sheet from the conveying roller pairs 26*a* of the sheet feeding and conveying unit 12 on the upstream side and grasp the leading end of the sheet. In this way, the sheet is transferred to the intermediate conveying drum 34*a* of the intermediate conveying unit 56*a* on the downstream side by rotation of the processing liquid application drum 30 in a state where the sheet is retained on the outer circumferential surface (outer surface) of the processing liquid application drum 30. As a result, the sheet is conveyed from the sheet feeding and conveying unit 12 on the upstream side to the intermediate conveying unit 56*a* on the downstream side. In the embodiment shown in the drawing, two chucks 32 are formed in the vicinity of the outer surface of the processing liquid application drum 30 in a point-symmetrical relation, and the processing liquid application drum 30 is configured to be capable of retaining two sheets on the outer surface thereof.

Similarly to the processing liquid application drum 30, two chucks 32 are formed in each of the intermediate conveying drums 34*a*, 34*b*, and 34*c* described later, an image forming drum 36, an ink drying drum 38, and an image fixing drum 40 which are processing barrels of the present invention. The chucks 32 transfer sheets from a drum on the upstream side to a drum on the downstream side.

A processing liquid applying device 42 and a processing liquid drying device 44 are arranged above the processing liquid application drum 30 along the circumferential direction of the processing liquid application drum 30. The processing liquid applying device 42 applies a processing liquid onto the recording surface of a sheet in a state where the processing liquid application drum 30 rotates with the sheet retained on the outer surface thereof, and the processing liquid is dried by the processing liquid drying device 44.

Here, the processing liquid has an effect of reacting with ink for forming an image to thereby aggregate colorants (pigments) and promote separation of colorants from a solvent. A storage unit 46 storing the processing liquid is provided in the processing liquid applying device 42, and a part of a gravure roller 48 is immersed in the processing liquid.

A rubber roller 50 is disposed in pressure-contact with the gravure roller 48. The rubber roller 50 comes into contact with the recording surface (front surface) of a sheet so that a processing liquid is applied to the recording surface of the sheet. Moreover, a squeegee (not shown) is in contact with the gravure roller 48 so as to control the amount of the processing liquid applied to the recording surface of the sheet.

On the other hand, hot-air nozzles 52 and an infrared heater (hereinafter referred to as an IR heater) 54 are arranged in the processing liquid drying device 44 in the vicinity of the surface of the processing liquid application drum 30. The hot-air nozzles 52 and the IR heater 54 evaporate a solvent such as water in the processing liquid and form a solid thin layer or a thin processing liquid layer on the recording surface of the sheet. By forming a thin processing liquid layer with a processing liquid drying step, dots of ink droplets ejected by the image forming unit 16 make contact with the sheet surface, and a necessary dot size is obtained. Moreover, the ink droplets react with the thin processing liquid layer to thereby aggregate colorants and fix the ink droplets to the sheet surface.

In this way, the sheet in which the processing liquid is applied to the recording surface and dried by the processing liquid application unit 14 is conveyed to the intermediate conveying unit 56*a* which is provided between the processing liquid application unit 14 and the image forming unit 16.

(Intermediate Conveying Unit)

The intermediate conveying drum 34*a* which is a transfer barrel used in the present invention is rotatably provided in the intermediate conveying unit 56*a*. The intermediate conveying drum 34*a* is disposed between the processing liquid application drum 30 of the processing liquid application unit 14 and the image forming drum 36 of the image forming unit 16. The chucks 32 are provided in the intermediate conveying drum 34*a* so as to receive the sheet from the processing liquid application drum 30 on the upstream side, and the leading end of the sheet is grasped by the chucks 32. The sheet is retained on the outer surface of the intermediate conveying drum 34*a*, and the sheet is transferred to the image forming drum 36 on the downstream side by rotation of the intermediate conveying drum 34*a*. In this way, the sheet is conveyed from the processing liquid application unit 14 on the upstream side to the image forming unit 16 on the downstream side.

The intermediate conveying unit 56*b* provided between the image forming unit 16 and the ink drying unit 18 and the intermediate conveying unit 56*c* provided between the ink drying unit 18 and the image fixing unit 20 have the same configuration as the intermediate conveying unit 56*a*. Therefore, redundant description thereof will not be provided.

(Image Forming Unit)

The image forming drum 36 is rotatably provided in the image forming unit 16. The image forming drum 36 is disposed between the intermediate conveying drum 34*a* and the intermediate conveying drum 34*b*. The chucks 32 are provided in the image forming drum 36 so as to receive the sheet from the intermediate conveying drum 34*a* on the upstream side, and the leading end of the sheet is grasped by the chucks 32. The sheet is retained on the outer circumferential surface of the image forming drum 36, and the sheet is transferred to the intermediate conveying drum 34*b* on the downstream side by rotation of the image forming drum 36. In this way, the sheet is conveyed from the intermediate conveying unit 56*a* on the upstream side to the intermediate conveying unit 56*b* on the downstream side.

A head unit 60 including four ink jet heads 58 is arranged above the image forming drum 36 in the vicinity of the surface of the image forming drum 36. In the head unit 60, ink jet heads 58 corresponding to at least four colors of YMCK which are the primary colors are arranged along the outer circumferential direction of the image forming drum 36. In the respective ink jet heads 58 of the respective colors, of the head unit 60, ink (in droplet form) is discharged (ejected) from nozzles onto the processing liquid layer formed on the recording surface of the sheet in the processing liquid application unit 14 in a state where the image forming drum 36 rotates with the sheet retained on the outer surface thereof. In this way, images of the respective colors are formed.

The processing liquid has the effect of causing colorants and latex particles dispersed in ink to be aggregated in the processing liquid, so that aggregates which do not cause a flow or the like of colorants on the sheet are formed. As an example of a reaction between the ink and the processing liquid, using a mechanism in which acid is contained in the processing liquid to break pigment dispersion by reducing the PH to form aggregates, bleeding of colorants, mixing of colors of the respective color ink components, and interference of ejection due to merging of liquid during landing of ink droplets are prevented.

The ink jet heads 58 eject ink droplets in synchronization with an encoder (not shown) that is disposed in the image forming drum 36 so as to detect a rotation speed of the image forming drum 36. By doing so, the ink jet heads 58 can determine the landing position with high accuracy and reduce ejection unevenness regardless of vibration of the image forming drum 36, the precision of a rotation shaft 62, a drum surface speed, and the like.

The head unit 60 is configured to be retracted from the upper part of the image forming drum 36. Maintenance operations such as cleaning of the nozzle surfaces of the ink jet heads 58 or discharging of thickened ink are performed by retracting the head unit 60 from the upper part of the image forming drum 36.

In the image forming unit 16, the sheet in which an image is formed on the recording surface is conveyed to the ink drying unit 18 by the intermediate conveying unit 56*b* provided between the image forming unit 16 and the ink drying unit 18 by rotation of the image forming drum 36.

(Intermediate Conveying Unit)

The intermediate conveying drum 34*b* is rotatably provided in the intermediate conveying unit 56*b*, and similarly, the chucks 32 are provided in the intermediate conveying drum 34*b*. The intermediate conveying drum 34*b* is disposed between the image forming drum 36 and the ink drying drum 38 so as to receive the sheet from the image forming drum 36 on the upstream side. The leading end of the sheet is grasped by the chucks 32, and the sheet is retained on the outer surface of the intermediate conveying drum 34*b*. The sheet is transferred to the ink drying drum 38 on the downstream side by rotation of the intermediate conveying drum 34*b*. In this way, the sheet is conveyed from the image forming unit 16 on the upstream side to the ink drying unit 18 on the downstream side.

(Ink Drying Unit)

The ink drying drum 38 which is a drying barrel used in the present invention is rotatably provided in the ink drying unit 18. A plurality of hot-air nozzles 64 and a plurality of IR heaters 66 are arranged above the ink drying drum 38 in the vicinity of the surface of the ink drying unit 18. Moreover, the ink drying drum 38 is disposed between the intermediate conveying drum 34*b* and the intermediate conveying drum 34*c* of the intermediate conveying unit 56*c*.

The chucks 32 are provided in the ink drying drum 38 so as to receive the sheet from the intermediate conveying drum 34*b* on the upstream side, and the leading end of the sheet is grasped by the chucks 32. The sheet is retained on the outer circumferential surface of the ink drying drum 38, and the sheet is transferred to the intermediate conveying drum 34*c* on the downstream side by rotation of the ink drying drum 38. In this way, the sheet is conveyed from the intermediate conveying unit 56*b* on the upstream side to the intermediate conveying unit 56*c* on the downstream side.

In the present embodiment, as an example, the hot-air nozzles 64 are arranged on the upstream side and the downstream side, and the IR heaters 66 each arranged in parallel to the hot-air nozzle 64 are alternately arranged. However, the arrangement of the hot-air nozzles 64 and the IR heaters 66 is not limited to this. For example, a large number of IR heaters 66 may be arranged on the upstream side so as to irradiate a lot of heat energy on the upstream side to increase the temperature of moisture, and a large number of hot-air nozzles 64 may be arranged on the downstream side so as to blow away saturated water vapor.

In the ink drying unit 18, in a state where the ink drying drum 38 is rotated with the sheet retained on the outer surface thereof, a solvent separated by the action of aggregating colorants is dried by warm air generated by the hot-air nozzles 64 and the IR heaters 66, and a thin image layer is formed in an image formation region of the sheet.

In the ink drying unit 18, the sheet in which the image on the recording surface is dried is conveyed to the image fixing unit 20 by the intermediate conveying unit 56*c* provided between the ink drying unit 18 and the image fixing unit 20 by rotation of the ink drying drum 38.

(Intermediate Conveying Unit)

The intermediate conveying drum 34*c* is rotatably provided in the intermediate conveying unit 56*c*, and similarly, the chucks 32 are provided in the intermediate conveying drum 34*c*. The intermediate conveying drum 34*c* is disposed between the ink drying drum 38 and the image fixing drum 40 so as to receive the sheet from the ink drying drum 38 on the upstream side. The leading end of the sheet is grasped by the chucks 32, and the sheet is retained on the outer surface of the intermediate conveying drum 34*c*. The sheet is transferred to the image fixing drum 40 on the downstream side by rotation of the intermediate conveying drum 34*c*. In this way, the sheet is conveyed from the ink drying unit 18 on the upstream side to the image fixing unit 20 on the downstream side.

(Image Fixing Unit)

The image fixing drum 40 is rotatably provided in the image fixing unit 20. The image fixing drum 40 is disposed between the intermediate conveying drum 34*c* and a conveying roller pair 26*b* of the discharging unit 21. The chucks 32 are provided in the image fixing drum 40 so as to receive the sheet from the intermediate conveying drum 34*c* on the upstream side, and the leading end of the sheet is grasped by the chucks 32. The sheet is retained on the outer circumferential surface of the image fixing drum 40. The sheet is transferred to the conveying roller pair 26*b* of the discharging unit 21 on the downstream side by rotation of the image fixing drum 40. In this way, the sheet is conveyed from the intermediate conveying unit 56*c* on the upstream side to the discharging unit 21 on the downstream side.

The image fixing unit 20 has a function of heating, pressurizing, and fusing latex particles in the thin image layer formed on the ink drying drum 38 to thereby immobilize and fix the latex particles onto the sheet while rotating the image fixing drum 40 in a state where the sheet is retained on the outer surface thereof.

A heating roller 68 is arranged above the image fixing drum 40 in the vicinity of the surface of the image fixing drum 40. The heating roller 68 is formed by incorporating a halogen lamp in a metal pipe of aluminum or the like having good heat conductivity, and the heating roller 68 imparts heat energy of the glass transition temperature Tg of latex or higher. In this way, the heating roller 68 fuses the latex particles and performs press-fixing on the irregularities on the sheet and levels the irregularities of the image surface to obtain glossiness.

A fixing roller 69 is provided in the image fixing unit 20 on the downstream side of the heating roller 68. The fixing roller 69 is arranged in pressure-contact with the surface of the image fixing drum 40 so that a nipping force is obtained between the fixing roller 69 and the image fixing drum 40. To realize this, an elastic layer is formed on at least one of the fixing roller 69 and the image fixing drum 40 so that a uniform nip width is created in relation to the sheet.

In the image fixing unit 20, the sheet in which an image is fixed onto the recording surface is conveyed toward the discharging unit 21 provided on the downstream side of the image fixing unit 20 by rotation of the image fixing drum 40.

In the present embodiment, although the image fixing unit 20 has been described, the image fixing unit 20 may not be provided if the ink drying unit 18 can dry and fix the image formed on the recording surface.

(Jam Detecting Unit)

As shown in FIG. 2, the jam detecting unit 22 includes a jam detection circuit 70, a first detection sensor 72, and a second detection sensor 74.

Here, the first detection sensor 72 is disposed at a predetermined distance from the outer surface of the intermediate conveying drum 34*b* of the intermediate conveying unit 56*b* that is disposed on the upstream side of the ink drying drum 38 of the ink drying unit 18. The first detection sensor 72 is configured to detect a pass of a sheet of which the leading end is grasped by the chucks 32 of the intermediate conveying drum 34*b*. For example, the first detection sensor 72 detects the leading end or the trailing end of a sheet and outputs a first sensor output signal.

Moreover, the second detection sensor 74 is disposed at a predetermined distance from the outer surface of the intermediate conveying drum 34*c* of the intermediate conveying unit 56*c* that is disposed on the downstream side of the ink drying drum 38. The second detection sensor 74 is configured to detect a pass of a sheet. For example, the second detection sensor 74 detects the leading end or the trailing end of a sheet and outputs a second sensor output signal.

The jam detection circuit 70 is an abnormal pass detecting circuit used in the present invention. The jam detection circuit 70 is configured to detect a jam, for example, a sheet abnormal pass such as a paper jam, from the first sensor output signal (hereinafter referred to as a "first sensor signal") from the first detection sensor 72 and the second sensor output signal (hereinafter referred to as a "second sensor signal") from the second detection sensor 74 and output a jam determination output signal.

The jam detection circuit 70 may employ an optional jam detection method if it can detect a jam using the first and second sensor signals. For example, the jam detection circuit 70 may employ a method according to the present embodiment shown in FIGS. 3 and 4 described later, in which a delay signal of the first detection signal detected from the first sensor signal is compared with a second detection signal detected from the second sensor signal, and a normal sheet pass and a jam are determined based on a match and a mismatch of the signals. The jam detection circuit 70 may employ a method similar to the jam detection method disclosed in JP 2001-96727 A and JP 2007-144633 A, in which the period between sheet detection timings based on two detection sensors is compared with a predetermined setting period or a predetermined calculation period to determine a jam. The jam detection circuit 70 may employ a method in which the period between the detection timings of the leading and trailing ends of a sheet based on one detection sensor is compared with a predetermined setting period or a predetermined calculation period to determine a jam.

In the ink jet recording apparatus 10, the ink drying unit 18 and the ink drying drum 38 thereof are very hot due to hot air from the hot-air nozzles 64 and the heat from the IR heaters 66. Thus, it is difficult to directly detect the occurrence of a jam in the ink drying unit 18. Therefore, in the present embodiment, the first and second detection sensors 72 and 74 for detecting a sheet pass are respectively provided in the intermediate conveying drums 34*b* and 34*c* on the upstream side and the downstream side of the ink drying drum 38. The first and second detection sensors 72 and 74 monitor a pass (the leading end and/or the trailing end) of a sheet. In this way, the occurrence of a jam in the ink drying unit 18 and the ink drying drum 38 thereof is detected.

In the present embodiment, although a reflective sensor, for example, a reflective optical sensor that receives light irradiated onto a sheet from a light-emitting element using a light-receiving element is used as the first and second detection sensors 72 and 74, the present invention is not limited to this. Various sensors including transmissive sensors as well as other types of reflective sensors can also be used.

Moreover, in the present embodiment, although two detection sensors, the first and second detection sensors 72 and 74 are respectively provided in the intermediate conveying drums 34*b* and 34*c* on the front and rear sides (the upstream side and the downstream side) of the ink drying drum 38, the present invention is not limited to this, and the two detection sensors may be respectively provided in two intermediate conveying drums on the front and rear sides of a processing barrel that performs certain processing on a sheet. For example, the two detection sensors may be respectively provided in the two intermediate conveying drums 34*a* and 34*b* on the front and rear sides of the image forming drum 36 so as to detect the occurrence of a jam in the image forming unit 16 and the image forming drum 36 thereof.

Moreover, one of the two detection sensors may be provided in an intermediate conveying drum on only one of the front and rear sides of a processing barrel, and the other detection sensor may be provided on a sheet conveying path on the other side of the processing barrel. For example, since an intermediate conveying drum is not disposed on the upstream side of the processing liquid application drum 30 of the processing liquid application unit 12, the second detection sensor 74 may be provided in the intermediate conveying drum 34*a* on the downstream side, and the first detection sensor 72 may be provided in one roller of the conveying roller pair 26*a* of the conveying unit 28 on the upstream side. Moreover, since an intermediate conveying drum is not disposed on the downstream side of the image fixing drum 40 of the image fixing unit 20, the first detection sensor 72 may be provided in the intermediate conveying drum 34*c* on the upstream side, and the second detection sensor 74 may be provided in one roller of the conveying roller pair 26*b* of the discharging unit 21 on the downstream side.

Furthermore, if a small decrease in the detection accuracy of the occurrence of a jam is allowed, one of the two detection sensors may be provided in only one intermediate conveying drum right before or right after a processing barrel, and the other detection sensor may be provided in an intermediate conveying drum or a conveying path which is located on the other side of the processing barrel and is far away from the above intermediate conveying drum.

Figure 3:
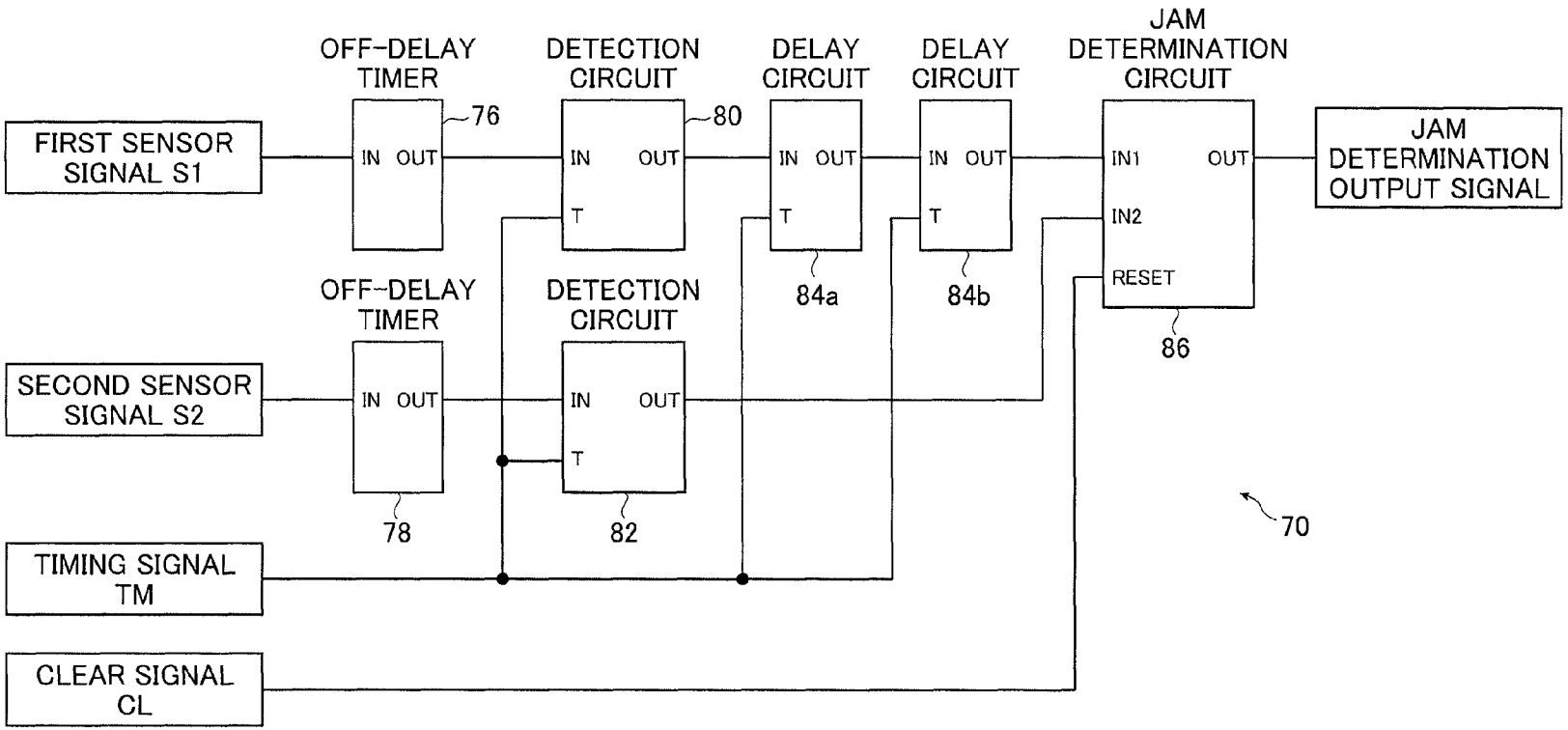
FIG. 3 is a block diagram of one example of a jam detection circuit of the ink jet recording apparatus shown in FIG. 2.

Next, the jam detection circuit of the present embodiment will be described in detail. FIG. 3 is a block diagram of one example of a circuit configuration of the jam detection circuit shown in FIG. 2.

The jam detection circuit 70 shown in FIG. 3 includes a first OFF-delay timer 76, a second OFF-delay timer 78, a first detection circuit 80, a second detection circuit 82, a first-stage delay circuit 84*a*, a second-stage delay circuit 84*b*, and a jam determination circuit 86.

The first OFF-delay timer 76 delays the timing of OFF which is a reverse logic of a first sensor signal S1 that is ON when the first detection sensor 72 detects a sheet pass by a predetermined timer setting period. The first OFF-delay timer 76 outputs a first sensor signal which is processed so as to cancel a shorter signal change in the first sensor signal S1 than the timer setting period, that is, a change to OFF state.

The second OFF-delay timer 78 delays the timing of OFF which is a reverse logic of a second sensor signal S2 that is ON when the second detection sensor 74 detects a sheet pass by a predetermined timer setting period. The second OFF-delay timer 78 outputs a second sensor signal which is processed so as to cancel a shorter signal change in the second sensor signal S2 than the timer setting period, that is, a change to OFF state.

The first detection circuit 80 detects the state of the first sensor signal processed by the first OFF-delay timer 76 at a predetermined detection timing (sensor check timing) of an input timing signal TM and acquires and outputs the detected state as a first detection signal. Here, the first detection circuit 80 outputs a pulse signal (ON pulse or flag) indicating sheet detection as the first detection signal when the state of the input first sensor signal is ON. The first detection signal maintains an OFF state when the state of the first sensor signal is OFF.

The second detection circuit 82 acquires the second sensor signal processed by the second OFF-delay timer 78 at a predetermined detection timing (sensor check timing) of an input timing signal TM and outputs the acquired second sensor signal as a second detection signal. Similarly, the second detection circuit 80 outputs a pulse signal (ON pulse or flag) indicating sheet detection as the second detection signal when the state of the input second sensor signal is ON. The second detection signal maintains an OFF state when the state of the second sensor signal is OFF.

The first and second-stage delay circuits 84*a* and 84*b* are configured to delay the pulse signal of the first detection signal output from the first detection circuit 80 in order to absorb a difference between the detection timing of the first detection signal based on detection of the first detection sensor 72 and the detection timing of the second detection signal based on detection of the second detection sensor 74. The first and second-stage delay circuits 84*a* and 84*b* delay the pulse signal of the first detection signal by an amount corresponding to the detection timing difference. In the present embodiment, the detection timing difference corresponds to two detection cycles. That is, the pulse signal is delayed twice in total, namely, in two stages in total by the first and second-stage delay circuits 84*a* and 84*b* each delaying the signal for a time period identical to one detection cycle. In this example, for example, the first and second-stage delay circuits 84*a* and 84*b* are flip-flops (FF) which are configured as a shift register, so that a delay amount corresponding to a necessary number of stages is realized.

That is, the timing signal TM is input to the first and second-stage delay circuits 84*a* and 84*b*, and the delay circuits 84*a* and 84*b* each delay the first detection signal by one stage whenever a detection timing pulse (check pulse) is input. In this way, a first detection signal obtained by delaying the pulse signal of the first detection signal by two stages is output from the second-stage delay circuit 84*b* on the rear stage.

In the present embodiment, although delay circuits are connected in two stages with the detection timing difference occurring twice, since the difference may occur once or three times or more depending on the positions of the first and second detection sensors 72 and 74, the number of stages of delay circuits may be set in accordance with the number of occurrences of the difference. Moreover, a delay amount corresponding to a necessary number of stages may be realized using one delay circuit.

The jam determination circuit 86 detects a match or a mismatch between the pulse signal of the first detection signal delayed by two stages, output from the second-stage delay circuit 84*b* and the pulse signal of the second detection signal output from the second detection circuit 82. When the two pulse signals are not identical, the jam determination circuit 86 determines it as a jam and outputs a jam determination output signal which is a pulse signal (ON pulse or flag). When the two pulse signals are identical, the jam determination circuit 86 determines it as a normal sheet pass and outputs a jam determination output signal of the OFF state. A clear signal CL is used for resetting the determination in the jam determination circuit 86.

In the present embodiment, although the jam detection circuit 70 is configured in this way, the respective constituent elements may be configured individually or may be configured by a field programmable gate array (FPGA).

Moreover, optical sensors used as the first and second detection sensors 72 and 74 may include an OFF-delay timer, an ON-delay timer, and the like. In such a case, timers incorporated in the first and second detection sensors 72 and 74 may be used as the first and second OFF-delay timers 76 and 78 in the jam detection circuit 70, and the first and second detection circuits 80 and 82, the first and second-stage delay circuits 84*a* and 84*b*, and the jam determination circuit 86 may be configured as an FPGA.

Next, the jam detection method of the jam detection circuit 70 according to the present embodiment will be described. In order to simplify the explanation, first, the jam detection method will be described based on the timing charts shown in FIGS. 4A to 4I in which the timer setting period of the first and second OFF-delay timers 76 and 78 shown in FIG. 3 is 0. A case where the timer setting period is 0 corresponds to a case where the first and second OFF-delay timers 76 and 78 are not provided in the jam detection circuit 70 shown in FIG. 3.

The timing signal TM shown in FIG. 4A shows that a check pulse indicating a sensor check timing, namely a sheet pass detection timing is output four times. In order to acquire such a timing signal TM, it is preferable to provide a timing sensor (not shown) so as to detect the timing at which the chucks 32 have passed through the first and second detection sensors 72 and 74. The timing signals TM are used for determining whether a sheet has been detected by the first and second detection sensors 72 and 74 at the timing when the timing sensor reacts and determining whether a jam has occurred or not during the period of the timing signals. This is because, when a sensor detection error by the first and second detection sensors 72 and 74 occurs, a problem in which a normal pass is erroneously determined as a jam may occur. The timing signals TM can be output in accordance with rotation of the intermediate conveying drum 34*b* or 34*c*, for example, by forming two dogs on a disk rotating in synchronization with rotation of the intermediate conveying drum 34*b* or 34*c* although not shown and disposing a timing sensor such as a photointerrupter so that the dogs are at light-blocking positions. In this case, the attachment angle of the disk including the dogs to the intermediate conveying drum 34*b* or 34*c* may be adjusted so that the timing signal can be output at the monitoring position of the sensor state.

The first sensor signal S1 output from the first detection sensor 72, shown in FIG. 4B is a pulse signal of which the detection logic is ON, and which indicates that the first detection sensor 72 has detected the chucks 32 and a sheet of which the leading end is grasped by the chucks 32. The first sensor signal S1 exhibits a short signal change at the last half thereof, which is considered to be attributable to a fluctuation of the trailing end of the sheet or the like. Although the first sensor signal S1 includes a short signal change, it shows that the sheet has been appropriately detected four times similarly to the timing signal TM shown in FIG. 4A. In the shown example, since the short signal change at the last half of the first sensor signal S1 occurs at different timings from the check pulse timings of the timing signal TM, such a change does not have an effect on generation of the subsequent pulse of a first detection signal DS1 in the first detection circuit 80.

The first detection signal DS1 shown in FIG. 4C is a signal output from the first detection circuit 80 and shows that an ON pulse indicating the ON state of the first sensor signal S1 is output in synchronization with the check pulse timings of the timing signal TM shown in FIG. 4A, input to the first detection circuit 80. In the shown example, the first detection signal DS1 shows that an ON pulse is output four times so as to correspond to each of the four check pulses of the timing signal TM.

A delayed first detection signal DD1 shown in FIG. 4D is a signal output from the second-stage delay circuit 84*b* and shows that the signal DD1 is a signal which is obtained by the first and second-stage delay circuits 84*a* and 84*b* delaying the first detection signal DS1 by two stages in accordance with the check pulses of the timing signal TM input to the first and second-stage delay circuits 84*a* and 84*b*.

A second sensor signal S2 output from the second detection sensor 74, shown in FIG. 4E is a signal which indicates that the second detection sensor 74 has detected the chucks 32 and a sheet of which the leading end is grasped by the chucks 32, similarly to the first sensor signal S1. The second sensor signal S2 exhibits a short signal change at the last half thereof, which is considered to be attributable to a fluctuation of the trailing end of the sheet or the like. However, the second sensor signal S2 indicates a signal that is delayed by two stages than the first sensor signal S1. Thus, although a sheet detection ON pulse corresponding to the third-stage check pulse of the timing signal TM is output, a sheet detection ON pulse corresponding to the fourth-stage check pulse of the timing signal TM is not output, which means that a sheet is not detected.

A second detection signal DS2 shown in FIG. 4F is a signal output from the second detection circuit 82 and shows that an ON pulse indicating the ON state of the second sensor signal S2 is output in synchronization with the check pulse timings of the input timing signal TM. In the shown example, the second detection signal DS2 shows that although an ON pulse corresponding to the third-stage check pulse of the timing signal TM is present, a pulse corresponding to the fourth-stage check pulse of the timing signal TM is not present.

A jam detection signal JFS shown in FIG. 4G is a signal generated in the jam determination circuit 86 and is a determination result signal indicating a match and a mismatch between the delayed first detection signal DD1 delayed by two stages, output from the second-stage delay circuit 84*b* and the second detection signal DS2 output from the second detection circuit 82, determined every check pulse of the timing signal TM. When the two signals are not identical, it is determined as a jam, and an ON pulse is generated. When the two signals are identical, it is determined as a normal sheet pass, and an OFF state is maintained. In the shown example, both the pulse signal of the delayed first detection signal DD1 and the pulse signal of the second detection signal DS2 corresponding to the third-stage check pulse of the timing signal TM are present. The two signals are determined to be identical, and the jam determination signal JFS maintains the OFF state indicating a normal sheet pass. However, although the pulse signal of the delayed first detection signal DD1 corresponding to the fourth-stage check pulse of the timing signal TM is present, since the pulse signal of the second detection signal DS2 is not present, the two signals are determined to be not identical, and a mismatch pulse indicating a jam is generated in the jam determination signal JFS. Since the second detection signal DS2 corresponding to the first and second-stage check pulses of the timing signal TM is not present, the OFF state is maintained.

A jam removal input signal JRI shown in FIG. 4H is a pulse indicating that a jam such as a jammed paper is removed and is an externally input signal.

A jam determination output signal JFO shown in FIG. 4I is a signal output from the jam determination circuit 86, which falls (turns ON) at the falling edge (OFF) of a mismatch pulse indicating a jam, of the jam determination signal JFS and rises (turns OFF) at the falling edge (OFF) of the jam removal input signal JRI. The ON state indicating a jam is maintained until a jam is removed after the jam is detected.

In the timing charts shown in FIGS. 4A to 4I, although an ON pulse is used by using ON as a detection logic, an OFF pulse may be used by using OFF as a detection logic.

As described above, in the jam detection method of the jam detection circuit 70 of the present embodiment, as shown in the timing charts of FIGS. 4A to 4I, the first detection circuit 80 acquires the first detection signal DS1 from the input first sensor signal S1 so as to correspond to the check pulses of the timing signal TM, the delayed first detection signal DD1 delayed by two stages by the first and second-stage delay circuits 84*a* and 84*b* is acquired from the first detection signal DS1, and the second detection circuit 82 acquires the second detection signal DS2 from the input second sensor signal S2. The jam determination circuit 86 compares the delayed first detection signal DD1 with the second detection signal DS2 to generate the jam determination signal JFS having a pulse indicating a mismatch and outputs the jam determination output signal JFO based on the jam determination signal JFS. The jam determination output signal JFO is maintained until the jam removal input signal JRI is input from the outside.

Subsequently, the functions of the first and second OFF-delay timers 76 and 78 in the jam detection method of the jam detection circuit 70 of the present embodiment will be described with reference to the timing charts shown in FIGS. 5A to 5E.

First, the present inventor has found that in the case of the intermediate conveying drums 34*a*, 34*b*, and 34*c* disposed before and after a processing barrel such as the ink drying drum 38 of the ink jet recording apparatus 10 of the present embodiment shown in FIG. 1, when conveying a sheet with only the leading end of the sheet grasped by the chucks 32 and the sheet retained on the outer surface of the drum, the sheet may fluctuate depending on the sheet thickness when the sheet passes through the detection sensors 72 and 74. Thus, it was difficult to detect a pass of the sheet stably.

Moreover, the present inventor has found that when reflective sensors, for example, are used as the first and second detection sensors 72 and 74 for detecting a jam, it was difficult to detect a pass of a sheet stably depending on the condition of the sheet (the magnitude of fluctuation due to the sheet thickness, a decrease in reflectivity due to the colors on the detection surface side of the sheet, in particular in the case of duplex printing, or the like) when the sheet passes through the detection sensors 72 and 74.

In particular, the present inventor has found that if a small signal change resulting from the sheet conditions such as a fluctuation of the sheet occurs in a range of the first and second sensor signals S1 and S2 corresponding to the check pulse of the timing signal TM, it was difficult to detect a pass of the sheet stably. As a result, the jam detection circuit 70 erroneously detects a jam even when the sheet has passed normally.

Therefore, in the present embodiment, the first and second OFF-delay timers 76 and 78 are operated with respect to the first and second sensor signals S1 and S2 output from the first and second detection sensors 72 and 74. In this way, a short signal change resulting from the sheet conditions is removed (canceled), so that a pass of the sheet can be stably detected.

Figures 5A, 5B, 5C, 5D, 5E:
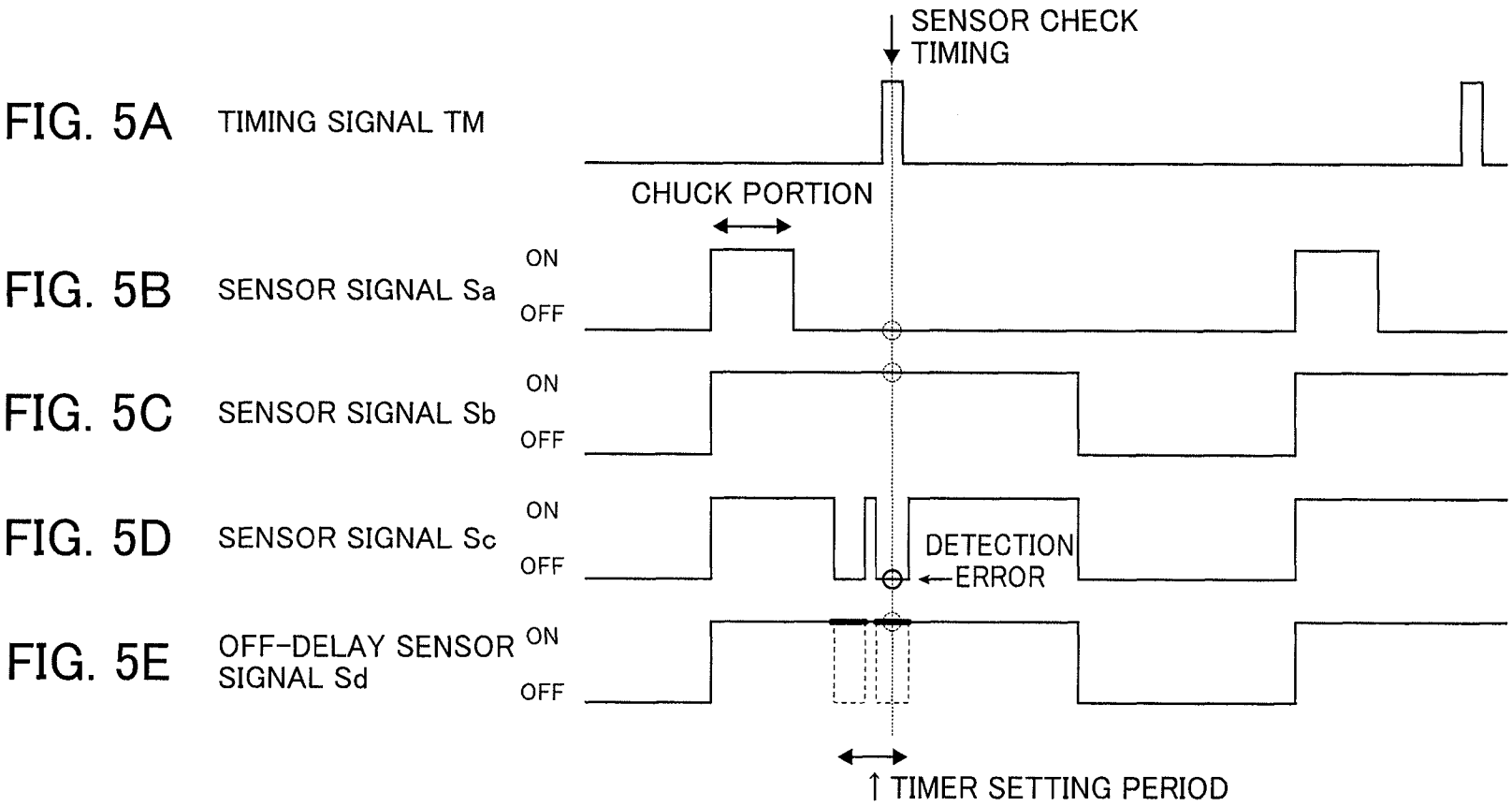
FIGS. 5A to 5E are timing charts of an example of a timing signal and sensor output signals, for explaining the effects of an OFF-delay timer of the jam detection circuit shown in FIG. 3.

FIG. 5A shows the timing signal TM, FIG. 5B shows a sensor signal Sa when a sheet is not present, FIG. 5C shows a sensor signal Sb when a sheet is present and is normal, FIG. 5D shows a sensor signal Sc when a sheet fluctuates, and FIG.

5E shows an OFF-delay sensor signal Sd when a sheet fluctuates, and an OFF delay is set. In this example, the first and second sensor signals S1 and S2 are not distinguished, and both are described as common sensor signals Sa to Sd.

The sensor signal Sa shown in FIG. 50 is a sensor signal when a sheet is not present and shows that only the chuck 32 is detected. At the sensor check timing of the timing signal TM shown in FIG. 5A, the detection circuit (80, 82) can correctly detect that a sheet is not present (OFF).

Next, the sensor signal Sb shown in FIG. 5C is a sensor signal when the chucks 32 and a sheet of which the leading end is grasped by the chucks 32 are detected and shows that the chuck 32 and the sheet are detected correctly. At the sensor check timing of the timing signal TM shown in FIG. 5A, the detection circuit (80, 82) can correctly detect that the sheet has passed (ON).

In contrast, the sensor signal Sc shown in FIG. 5D is a sensor signal when a sheet fluctuates although the chucks 32 and the sheet of which the leading end is grasped by the chucks 32 are detected. The sensor signal Sc shows that a short signal change occurs in the period when the chucks 32 and the leading end of the sheet are correctly detected. Since a short signal change occurs at the sensor check timing of the timing signal TM shown in FIG. 5A, the detection circuit (80, 82) detects that the sheet is not present (OFF) although the sheet has passed. As a result, detection errors occur.

Therefore, in the present embodiment, the OFF-delay sensor signal Sd shown in FIG. 5E is used. The OFF-delay sensor signal Sd is a signal which is made to be the same as the sensor signal Sb shown in FIG. 5C by operating the OFF-delay timer (76, 78) of which the timer setting period is set to the shown length with respect to the sensor signal Sc shown in FIG. 5D to thereby cancel a shorter signal change (OFF state) than the timer setting period. Thus, even when a short signal change occurs in the sensor signal Sc at the sensor check timing of the timing signal TM shown in FIG. 5A, the detection circuit (80, 82) can correctly detect that the sheet has passed (ON) based on the OFF-delay sensor signal Sd.

As a result, it can be understood that, using the OFF-delay sensor signal Sd shown in FIG. 5E, detection errors occurring with the sensor signal Sc shown in FIG. 5D can be eliminated.

In the above-described example, although the sensor check timing of the timing signal TM is set based on the timing at which the chucks 32 have passed through the first and second detection sensors 72 and 74, the present invention is not limited to this. When a conveying speed of a sheet is variable, or the sheet length is variable, the sensor check timing of the timing signal TM may be changed in accordance with the conveying speed or the sheet length. For example, a delay may be provided to the sensor check timing, and a delay may be provided to the detection timing of the chucks 32.

Moreover, various conditions such as a sheet conveying speed, a sheet length, or sheet conditions can be dealt with by switching the OFF-delay timer setting period of the OFF-delay timer (76, 78), in particular, by switching the OFF-delay timer setting period in accordance with a change or a delay in the sensor check timing of the timing signal TM.

In the present invention, for example, an intrusion of a short sheet can be detected by setting the timer setting period of the OFF-delay timer (76, 78) to be very long and delaying the sensor check timing of the timing signal TM.

FIGS. 6A to 6E show timing charts of a timing signal and sensor output signals, for explaining the effect of an OFF-delay timer according to the second embodiment of the present invention.

Here, FIG. 6A shows the timing signal TM, FIG. 6B shows a sensor signal Sa when a sheet is not present, FIG. 6C shows an OFF-delay sensor signal Se when a sheet is not present, FIG. 6D shows a sensor signal Sf when a short sheet enters, and FIG. 6E shows an OFF-delay sensor signal Sg when a short sheet enters, and an OFF delay is set. In this example, the first and second sensor signals S1 and S2 are not distinguished, and both are described as common sensor signals Sa, Sb, and Se to Sg.

The timing signal TM shown in FIG. 6A shows that the sensor check timing is more delayed from the pulse of the sensor signal Sa indicating detection of the chucks 32, shown in FIG. 6B than that shown in FIGS. 5A and 5B.

The sensor signal Sa shown in FIG. 6B is the same as the sensor signal Sa shown in FIG. 5B and shows that at the delayed sensor check timing of the timing signal TM shown in FIG. 6A, the detection circuit (80, 82) can correctly detect that a sheet is not present (OFF).

Next, the OFF-delay sensor signal Se shown in FIG. 6C is a signal obtained when the OFF-delay timer (76, 78) is operated with respect to the sensor signal Sa shown in FIG. 6B so that the timer setting period thereof is set to be greatly longer than the timer setting period shown in FIG. 5E. Similarly to the sensor signal Sa shown in FIG. 6B, the detection circuit (80, 82) can correctly detect that a sheet is not present (OFF).

The sensor signal Sf shown in FIG. 6D is a signal indicating that an entering short sheet is detected although the signal becomes OFF after the chucks 32 are detected. The sensor signal Sf shows that the detection circuit (80, 82) is unable to detect at the sensor check timing although a short sheet has passed but detects that the sheet is not present (OFF). As a result, detection errors occur.

In contrast, the OFF-delay sensor signal Sg shown in FIG. 6E shows that the OFF-delay timer (76, 78) of which the timer setting period having the shown length is set to be greatly longer than the timer setting period shown in FIG. 5E is operated with respect to the sensor signal Sf shown in FIG. 6D to delay a change to the OFF state. The OFF-delay sensor signal Sg shows that at the sensor check timing of the timing signal TM shown in FIG. 6A, the detection circuit (80, 82) can correctly detect that the sheet has passed (ON).

From the above results, it can be understood that, similarly to the sensor signal Sa shown in FIG. 6B, using the OFF-delay sensor signal Se shown in FIG. 6C, it is possible to correctly detect absence (OFF) of a sheet. Moreover, it can be understood that, using the OFF-delay sensor signal Sg shown in FIG. 6E, it is possible to detect the entrance of a short sheet which is difficult to detect based on the sensor signal Sf shown in FIG. 6D.

By allowing the first and second detection sensors 72 and 74, in particular, the first detection sensor 72 to detect a pass of an abnormal sheet such as a short sheet as much as possible, it is possible to improve jam detection efficiency. By arranging a plurality of sensors also in a width direction orthogonal to the sheet conveying direction, the efficiency of detecting an abnormal sheet can be improved further.

In the example described above, the ON logic is used as the detection logic of the first and second detection sensors 72 and 74, and the first and second OFF-delay timers 76 and 78 are used as the reverse logic delay timer that delays the timing of a logic reverse to the detection logic of the detection sensors 72 and 74 with respect to the sensor signal output from the detection sensor. However, the present invention is not limited to this, and the ON-delay timers may be used by using the OFF logic as the detection logic of the first and second detection sensors 72 and 74.

Figure 7A:
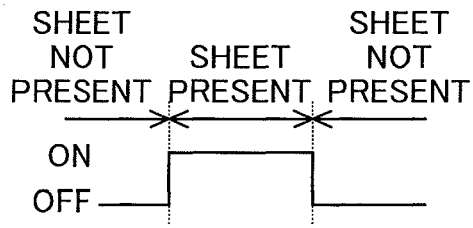
FIGS. 7A, 7B, and 7C are timing charts of an example of an output signal of a detection sensor and output signals of an OFF-delay timer and an ON-delay timer used in the present invention.
Figure 7B:
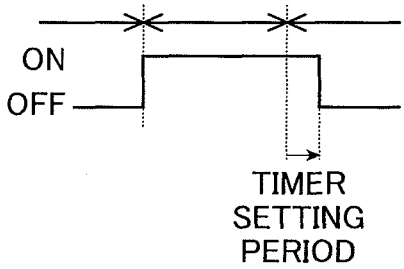
Figure 7C:
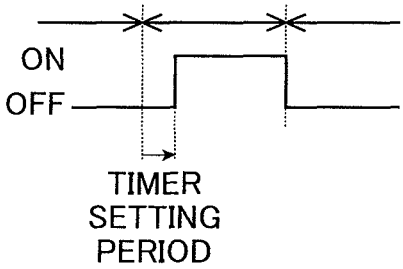

In order to compare with the OFF-delay timer, the operation of the ON-delay timer will be described with reference to FIGS. 7A to 7C showing an example of the timing charts of the output signal of the detection sensor and the output signals of the OFF-delay timer and the ON-delay timer.

FIG. 7A shows a sensor output signal of the detection sensor, and an ON pulse occurs in only a portion where a recording sheet to be detected is present.

In contrast, FIG. 7B shows the output signal of the OFF-delay timer with respect to the sensor output signal shown in FIG. 7A. It can be understood that the timing to change to OFF is delayed by a timer setting period with respect to the sensor output signal shown in FIG. 7A.

Moreover, FIG. 7C shows the output signal of the ON-delay timer with respect to the sensor output signal shown in FIG. 7A. It can be understood that the timing to change to ON is delayed by a timer setting period with respect to the sensor output signal shown in FIG. 7A.

The timer setting period used in the examples shown in FIGS. 5E, 6C, and 6E, the setting timing of the sensor check timing of the timing signal, and the delay period can be set in accordance with conditions such as the thickness, elasticity, and density of a sheet being used, in particular, sheet conditions such as the surface density, the structure and grasping strength of the chucks grasping the leading end of a sheet, the structure of an intermediate conveying drum (a transfer barrel) in which the sheet of which the leading end is grasped by chucks is retained on the outer surface thereof, or a sheet fluctuation. For example, an intermediate conveying drum receives a recording sheet on which an image based on ink droplets is formed from the image forming drum 36 in a state where the image formation surface of the recording sheet is on the outer surface side of the intermediate conveying drum. Thus, it is necessary to ensure that a predetermined region of the outer surface of the intermediate conveying drum is not in direct contact with the image formation region of the image formation surface of the recording sheet. Therefore, the recording sheet retained on the outer surface of the intermediate conveying drum in a state where the leading end thereof is grasped by the chucks may fluctuate. As such, it is preferable to determine the timer setting period, the setting timing of the sensor check timing of the timing signal, and the delay period in advance by taking the above conditions which can make the detection signal of the detection sensor unstable into consideration. Naturally, experiments may be performed in advance with respect to combinations of intermediate conveying drums and sheets, and the timer setting period, the setting timing of the sensor check timing of the timing signal, and the delay period may be determined based on the results of the experiments.

While the ink jet recording apparatus according to the present invention has been described in detail above, the present invention is not limited to the above embodiments. It should be understood that various improvements and modifications may be made without departing from the scope and spirit of the invention.

What is claimed is:

1. An ink jet recording apparatus that ejects droplets from nozzles of an ink jet head to record an image on a cut sheet-shaped recording medium, comprising:

a processing barrel that performs predetermined processing on the recording medium while rotating with the recording medium retained on an outer circumferential surface thereof;

a transfer barrel that is disposed on an upstream side or a downstream side in a conveying direction of the recording medium with respect to the processing barrel so as to retain the recording medium on an outer surface thereof and transfer or receive the recording medium to or from the processing barrel by rotating with a leading end of the recording medium grasped;

a conveying unit that is disposed on the opposite side of the transfer barrel in the conveying direction of the recording medium with respect to the processing barrel so as to convey the recording medium from or to the processing barrel;

a first detection sensor and a second detection sensor that are provided so as to face the transfer barrel and the conveying unit to detect a pass of the recording medium; and an abnormal pass detecting circuit that receives a first output signal output from the first detection sensor and a second output signal output from the second detection sensor so as to detect an abnormal pass of the recording medium from the received first and second output signals, wherein the abnormal pass detecting circuit includes a first reverse logic delay timer that delays timing of a logic reverse to a detection logic of the first detection sensor with respect to the first output signal, and a second reverse logic delay timer that delays timing of a logic reverse to a detection logic of the second detection sensor with respect to the second output signal, and wherein signal changes shorter than timer setting periods of the first and second reverse logic delay timers are removed from the first and second output signals, respectively, to thereby prevent detection errors of the abnormal pass of the recording medium by the abnormal pass detecting circuit.

2. The ink jet recording apparatus according to claim 1, wherein the first and second detection sensors are sensors of which the detection logics become ON when the recording medium passes, and wherein the first and second reverse logic delay timers are OFF-delay timers that add an OFF delay to the first and second output signals.

3. The ink jet recording apparatus according to claim 1, wherein the first and second detection sensors are sensors of which the detection logics become OFF when the recording medium passes, and wherein the first and second reverse logic delay timers are ON-delay timers that add an ON delay to the first and second output signals.

4. The ink jet recording apparatus according to claim 1, wherein the first and second reverse logic delay timers are each configured to be capable of switching the timer setting period thereof, and wherein the abnormal pass detecting circuit is configured to be capable of switching the detection timing at which the first and second detection signals indicating a pass of the recording medium are detected from the first and second output signals, respectively.

5. The ink jet recording apparatus according to claim 1, wherein the timer setting period of each of the first and second reverse logic delay timers and the detection timing of the abnormal pass detecting circuit at which the first and second detection signals indicating a pass of the recording medium are detected from the first and second output signals, respectively, are switched in accordance with the length of the recording medium in the conveying direction and a conveying speed of the recording medium in the transfer barrel and the conveying unit.

6. The ink jet recording apparatus according to claim 4, wherein the detection timing is delayed from the timing of the first output signal, indicating the pass of the recording medium by the timer setting period of the first reverse logic delay timer or longer.

7. The ink jet recording apparatus according to claim 1, wherein the processing barrel performs the predetermined processing on the recording medium while retaining the recording medium on the outer circumferential surface thereof by rotating with the leading end of the recording medium grasped.

8. The ink jet recording apparatus according to claim 1, wherein one of the transfer barrel and the conveying unit is a first transfer barrel that is disposed on the upstream side in the conveying direction of the recording medium with respect to the processing barrel so as to retain the recording medium on the outer surface thereof and transfer the recording medium to the processing barrel by rotating with the leading end of the recording medium grasped, and wherein the other of the transfer barrel and the conveying unit is a second transfer barrel that is disposed on the downstream side in the conveying direction of the recording medium with respect to the processing barrel so as to retain the recording medium on the outer surface thereof and receive the recording medium from the processing barrel by rotating with the leading end of the recording medium grasped.

9. The ink jet recording apparatus according to claim 8, wherein the processing barrel includes a first grasping unit that grasps the leading end of the recording medium, and is configured to rotate while retaining the recording medium of which the leading end is grasped by the first grasping unit on the outer circumferential surface thereof to thereby perform the predetermined processing on the recording medium, wherein the first transfer barrel includes a second grasping unit that grasps the leading end of the recording medium, and is configured to rotate in contact with the processing barrel while retaining the recording medium of which the leading end is grasped by the second grasping unit on the outer surface thereof to thereby transfer the recording medium to the processing barrel by changing the state of the recording medium being grasped by the second grasping unit to the state of the recording medium being grasped by the first grasping unit of the processing barrel, and wherein the second transfer barrel includes a third grasping unit that grasps the leading end of the recording medium, and is configured to rotate in contact with the processing barrel while retaining the recording medium of which the leading end is grasped by the third grasping unit on the outer surface thereof to thereby receive the recording medium from the processing barrel by changing the state of the recording medium being grasped by the first grasping unit of the processing barrel to the state of the recording medium being grasped by the third grasping unit.

10. The ink jet recording apparatus according to claim 1, wherein the abnormal pass detecting circuit includes a first detection circuit that outputs a first detection signal indicating the pass of the recording medium based on a predetermined detection timing signal from the first output signal which is output from the first detection sensor and processed by the first reverse logic delay timer, a delay circuit that delays the first detection signal output from the first detection circuit by a predetermined setting period and outputs a delayed first detection signal, a second detection circuit that outputs a second detection signal indicating the pass of the recording medium based on the predetermined detection timing signal from the second output signal which is output from the second detection sensor and processed by the second reverse logic delay timer, and an abnormal pass determining circuit that determines the abnormal pass of the recording medium from the delayed first detection signal output from the delay circuit and the second detection signal output from the second detection circuit.

11. The ink jet recording apparatus according to claim 10, wherein the abnormal pass determining circuit compares the delayed first detection signal with the second detection signal to determine the abnormal pass of the recording medium.

12. The ink jet recording apparatus according to claim 10, wherein the abnormal pass determining circuit compares the delayed first detection signal and the second detection signal to determine that the pass of the recording medium is normal when both signals are identical and determine that the pass of the recording medium is abnormal when both signals are not identical.

13. The ink jet recording apparatus according to claim 1, wherein the processing barrel is a drying barrel that rotates while retaining the recording medium on which the image is recorded by the ink jet head on the outer circumferential surface thereof so as to dry the image formed by the droplets on the recording medium.

14. The ink jet recording apparatus according to claim 1, wherein the processing barrel is an image forming barrel that rotates while retaining the recording medium on the outer circumferential surface thereof to convey the recording medium and ejects droplets from the nozzles of the ink jet head to thereby form the image.

15. The ink jet recording apparatus according to claim 1, wherein the first and second detection sensors are reflective sensors.

16. The ink jet recording apparatus according to claim 1, wherein the first and second detection sensors detect the leading end of the recording medium.

* * * * *